US005619840A

United States Patent [19]

Nyman et al.

[11] Patent Number: 5,619,840

[45] Date of Patent: Apr. 15, 1997

[54] PACKAGE AND A PROCEDURE FOR PACKING BAGS INTO A ROLL

[75] Inventors: Per Nyman, Ulvila; Veikko Koivumäki, Pori, both of Finland

[73] Assignee: Oy W. Rosenlew AB, Pori, Finland

[21] Appl. No.: 373,238

[22] PCT Filed: Jul. 14, 1990

[86] PCT No.: PCT/FI93/00295

§ 371 Date: Jan. 10, 1995

§ 102(e) Date: Jan. 10, 1995

[87] PCT Pub. No.: WO94/02361

PCT Pub. Date: Feb. 3, 1994

[30] Foreign Application Priority Data

Jul. 15, 1992 [FI] Finland ..... 923236

[51] Int. Cl.[6] ..... B65B 63/04; B65B 25/14

[52] U.S. Cl. ..... 53/430; 53/116; 53/118; 53/429; 242/528; 206/390; 206/554

[58] Field of Search ..... 206/389, 391, 206/397, 412, 390, 554; 383/7, 8, 37; 242/160.1, 160.4, 528; 53/429, 430, 116, 117, 118

[56] References Cited

U.S. PATENT DOCUMENTS

| | | | |
|---|---|---|---|
| 3,237,363 | 3/1966 | Spohr | 53/429 |
| 3,647,060 | 3/1972 | Kiely | 206/389 |
| 3,718,253 | 2/1973 | Smith | 206/554 X |
| 4,069,944 | 1/1978 | Achelpohl . | |
| 4,597,494 | 7/1986 | Benoit | 53/430 X |
| 4,807,754 | 2/1989 | Rowe . | |
| 4,818,328 | 4/1989 | Hara | 53/118 X |
| 4,832,506 | 5/1989 | Juel et al. | 383/8 |
| 4,948,638 | 8/1990 | Francis | 53/429 X |
| 5,002,400 | 3/1991 | Strand | 383/7 X |
| 5,192,133 | 3/1993 | Juel et al. | 383/7 |
| 5,290,104 | 3/1994 | Sengewald | 206/554 X |

FOREIGN PATENT DOCUMENTS

| | | |
|---|---|---|
| 59064 | 12/1976 | Finland . |
| 427450 | 4/1980 | Sweden . |
| 1594558 | 7/1981 | United Kingdom . |

*Primary Examiner*—Daniel Moon

*Attorney, Agent, or Firm*—Steinberg, Raskin & Davidson, P.C.

[57] ABSTRACT

The present invention relates to a delivery package (30) of maxi bags (10) and a method for packing maxi bags into a delivery package (30). A delivery package (30) consists of maxi bags (10) placed overlappingly one top of the other, said bags being rolled around a rolling core (20) into a roll package. The edge portions of the maxi bags (10) have been folded prior to being conducted to a rolling core (20) so that in longitudinal direction the maxi bags (10) are essentially of equal thickness, whereby in each maxi bag layer of a delivery package (30) the undesired thickness of the thick handle part of the lifting loop structure (13) of the maxi bags (10) has been made uniform in order to produce a stable delivery package (30).

15 Claims, 2 Drawing Sheets

PACKAGE AND A PROCEDURE FOR PACKING BAGS INTO A ROLL

FIELD OF THE INVENTION

The present invention relates to a delivery package for mad bags i.e., flexible intermediate bulk containers.

The invention also relates to a procedure for packing maxi bags to form delivery packages.

BACKGROUND OF THE INVENTION

In the state of an it is generally known in manufacturing paper bags to produce bag rolls of paper bags, i.e. paper bag delivery packages so that the finished paper bags placed overlappingly one on top of the other are rolled around a rolling core, and in the course of the rolling, i.e. in the course of forming a delivery package, the paper bag layers are tied with the aid of two continuous cords or hoops surrounding the bag roll.

The technique described above has also been used in packing plastic sacks into a delivery package.

Small bags have long been filled completely automatically. On the other hand, automatic filling of maxi bags has not been known in the state of art, even though automatic filling of maxi bags is technically possible. In order to succeed in filling automatically maxi bags, the maxi bags should be delivered to the users thereof in a precisely organized manner in one way or another, i.e. in a delivery package of a given type, so that the grip of a robot or a collector means is always able to find a subsequent maxi bag to be filled.

In maxi bags, particularly in maxi bags provided with gathered lifting loops, the gathered lifting loop structure generates a considerable thickening compared with the rest of the maxi bag structure. Such maxi bags cannot to date have been packed into a roll package, i.e. into a delivery package, because it has proved to be impossible to make a stable roll package. In maxi bags like these the gathered lifting loop structure is also in general surrounded with a separate handle, whereby when maxi bags are rolled around a rolling core so that the lifting handle is placed in the middle and the maxi bags are placed one after the other overlappingly one on top of the other, the end result would be a very uneven roll package owing to the thick and narrow handle portion, which, along with the increasing diameter of said roll package, would no longer stay in gathered form, but would spread apart.

OBJECTS AND SUMMARY OF THE INVENTION

The objective of the present invention is to provide a delivery package of maxi bags which is sufficiently stable. A specific aim of the invention is to provide a delivery package of maxi bags enabling automatic maxi bag filling.

One more aim of the invention is also to provide a method for packing maxi bags into delivery packages, enabling the provision of a sufficiently uniformly thick and stable roll package, so that automatic maxi bag filling is simultaneously made feasible.

The aims of the invention are achieved by means of a delivery package of maxi bags, which is mainly characterized in that the delivery package consists of maxi bags placed overlappingly one on top of the other, said bags being rolled around a rolling core into a roll package so that the edge portions of the maxi bags have been folded prior to conducting to the rolling core so that the maxi bags are longitudinally substantially of the same thickness whereby the undesired thickness of the thick handle part of the lifting loop structure of maxi bags has been made uniform in each maxi bag layer in order to produce a stable delivery package.

The procedure of the invention is mainly characterized in that (a) the maxi bags are placed in a packing line overlappingly one on top of the other and conducted through folding guides in folding position, said guides folding the edge portions of the maxi bags longitudinally in order to produce a maxi bag of substantially equal thickness, and (b) the maxi bags folded in the edge portions are conducted to a rolling core and are rolled around the rolling core into a roll package.

The insight in a maxi bag delivery package and in the procedure for packing the same into delivery package is to make even the undesired unthickness of the handle part of the maxi bags by folding the edge portions of the maxi bags so with the folding guides that, in its entire length, the maxi bag is substantially of equal thickness. Each layer produced from maxi bags positioned overlappingly one on top of the other has been tied with at least one cord or hoop.

In an alternative embodiment of the invention, only the topmost maxi bag layer of a delivery package is fled With at least one cord or hoop.

With the delivery package of maxi bags and the procedure for packing said maxi bags, a plurality of significant advantages are achieved. The delivery package becomes stable and sufficiently compact, whereby a sufficient number of maxi bags can be packed into a small volume. Therefore, the storing and transport costs are low. Treating complete maxi bags delivery packages is easy and rapid and, in addition, when filling maxi bags later, a complete delivery package can be so unpackaged that the automatic filling of maxi bags is simultaneously possible, resulting in considerable savings in filling said maxi bags. As a matter of fact, maxi bags can be filled also manually, as is a general practice.

Since in the maxi bag delivery package according to the invention the maxi bags are positioned on a roll, taking out one maxi bag has been made much easier. Hereby, the unpacking from a roll can easily be arranged to take place so that the maxi bag is every time released in the same location, where a robot arm finds it easily and is thus able to move the maxi bag to the filling station.

The invention is described more in detail, referring to a preferred embodiment of the invention presented in the figures of the accompanying drawings, to which the invention is not, however, intended to be exclusively confined.

DESCRIPTION OF THE INVENTION

Figure 1:
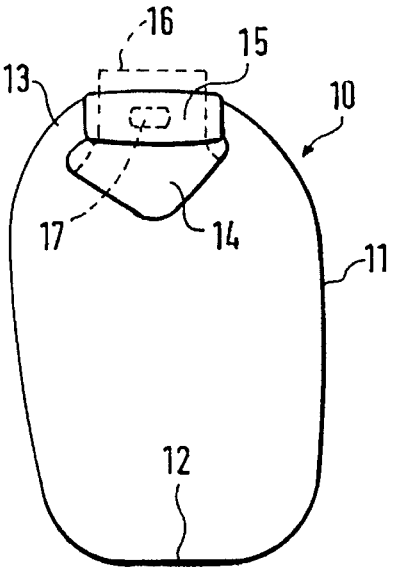
FIG. 1 presents in elevational view a maxi bag known in the state of art.
Figure 2:
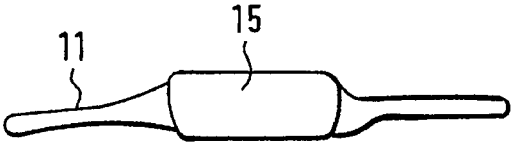
FIG. 2 presents a cross-section of a maxi bag shown in FIG. 1.

The maxi bag known in itself, presented in FIGS 1 and 2, is in general indicated by reference numeral 10. The maxi bag 10 comprises an envelope 11, a bottom 12, a lifting loop structure 13, and a filling aperture 14. In the present embodiment, the lifting loop structure 13 consists of two separate lifting loops gathered into one and surrounded with a handle part 15. The inner bag 16 is depicted with a broken line in FIG. 1. The joining 17 of the handle part 15 of the lifting loop structure 13 to the inner bag 16 is in FIG. 1 depicted with broken lines. As is best seen in FIG. 2, the handle part 15 of the maxi bag 10 is considerably thicker than the rest of the structure of the maxi bag 10. For reasons of clarity, the inner bag 16 is not shown in FIG. 2.

Figure 3:
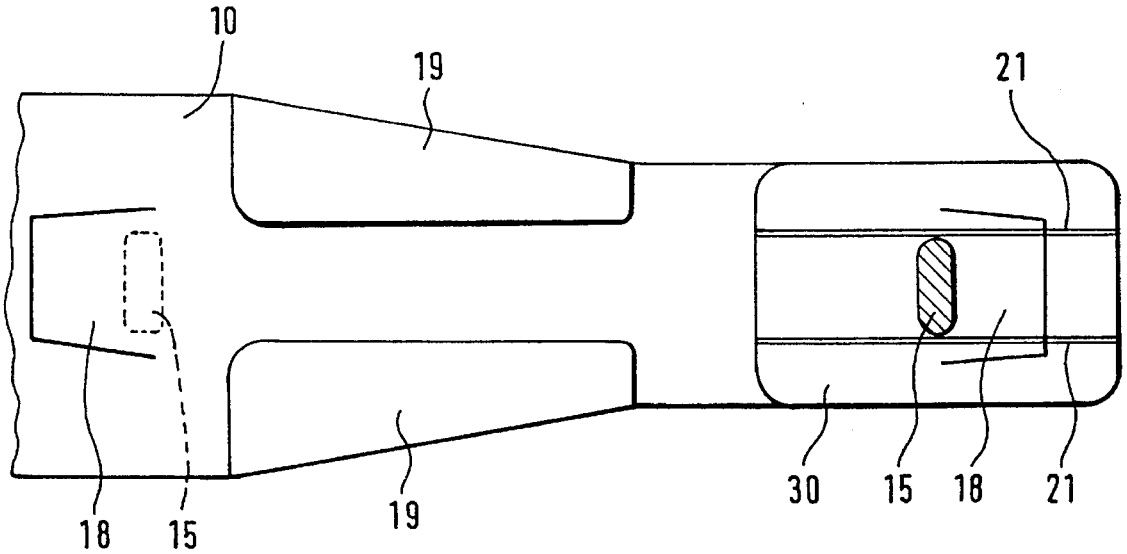
FIG. 3 presents schematically a preferred embodiment of the procedure of the invention in top view.

In the procedure according to the invention, the maxi bags 10 are positioned in overlapping position one on top of the other on a packing line and the maxi bags first pass through a folding station or a bending station, whereby the folding guides 19 of the folding station fold the edge portions of the maxi bags 10 inwards, so that the maxi bags 10 are in longitudinal direction substantially of equal thickness, as is shown in FIG. 3. In an embodiment as shown in FIG. 3, maxi bags are fed to go forward so that the bottom 12 of the maxi bag 10 is in the feeding direction. This is not, however, necessary because the maxi bags 10 may equally be fed so that the lifting part of the maxi bag 10 is in the feeding direction. The embodiment according to FIG. 3, however, offers the remarkable advantage that from a complete delivery package 30 maxi bags 10 can be unpacked so that the top parts of the maxi bags 10 is first unpacked, whereby the filling of maxi bags 10 is easier and it can be automated.

Figure 4:
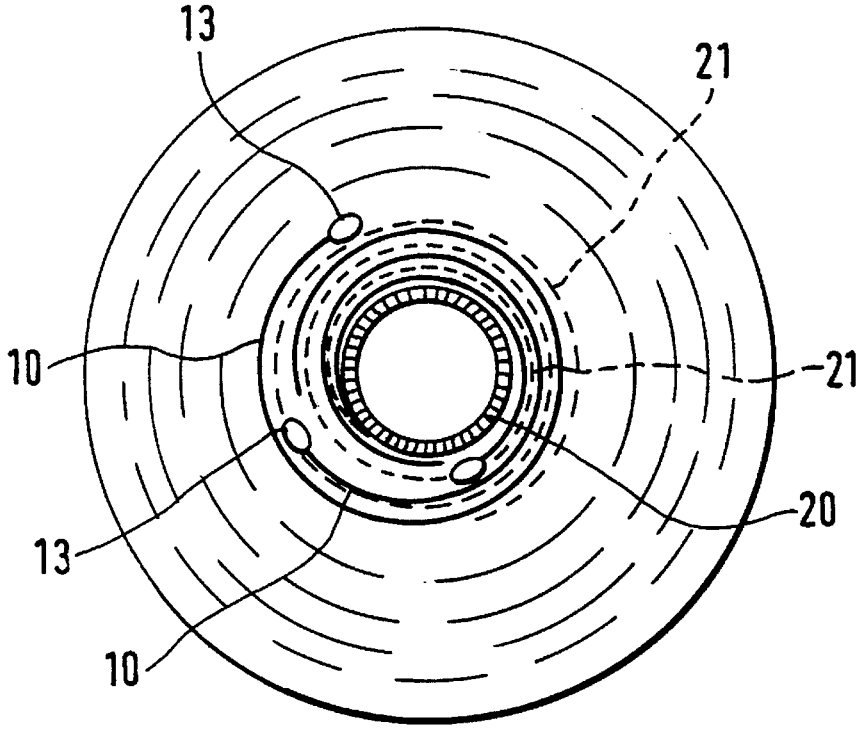
FIG. 4 shows a completed maxi bag delivery package of the invention in elevational view.
Figure 5:
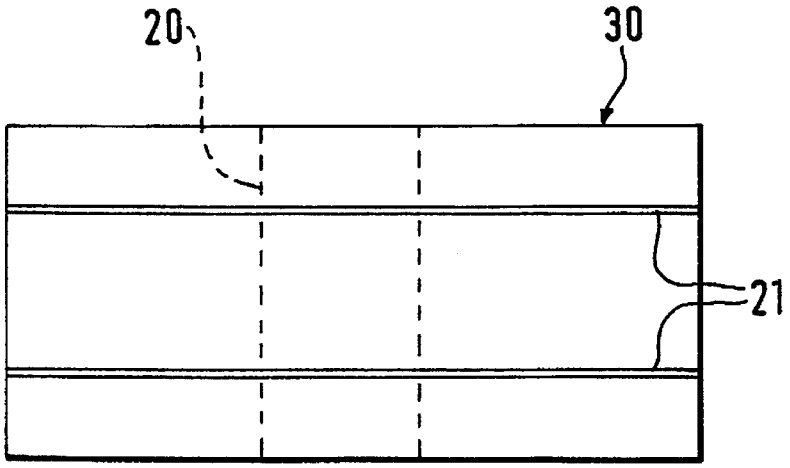
FIG. 5 shows the delivery package according to FIG. 4, in top view.

The maxi bags 10 folded inwards in the edge portions travel as a uniform overlapping flow to a rolling core 20 to be rolled around the rolling core 20. In FIG. 3 the mouth part of the inner bag 16 is indicated by reference numeral 18. At the packing station each maxi bag layer is surrounded by one or more continuous cords or hoops 21, whereby a delivery package, i.e. roll package 30, is produced as shown in FIGS. 4 and 5. In embodiment according to FIG. 3, two pieces of cords or hoops 21 are provided, but the invention is not critical to the number thereof.

Using continuous cords or hoops 21 is preferable because each maxi bag layer of a complete delivery package 30 is then as fight and compact as possible, whereby a delivery package 30 large in diameter is sufficiently fight and stable. Using continuous cords or hoops 21 around each maxi bag layer is not inevitable, instead, a maxi bag delivery package 30 can be so produced that each separate maxi bag layer is not surrounded with cords or hoops 21, but only the topmost layer of a complete maxi bag delivery package 30 is surrounded with cords or hoops 21.

The maxi bag delivery package 30 according to the invention can be treated with ease and speedily in a fill-in place e.g. as follows. An automaton included in the fill-in apparatus unpacks from a delivery package, that is, from a roll package 30, one maxi bag 10 at a time and conveys said maxi bag 10 to a fill-in station. No additional measures are needed now regarding the arrangement of maxi bags 10 in filling them with bulk goods. No methods exist today which would make an automatic filling-in of maxi bags completely without any need of manual operation in the above-described manner.

Merely the principle design of the invention and some advantageous embodiments thereof are described above. It is obvious to a person skilled in the art that a plurality of modifications can be made in the above embodiments within the scope of the inventive idea presented in the accompanying claims.

We claim:

1. A delivery package of flexible intermediate bulk containers, comprising a cylindrical rolling core, and a plurality of flexible intermediate bulk containers placed in an overlapping relationship in layers about said rolling core, each of said containers including a elongate container portion having a first width and a first thickness and a handle part connected to said container portion, said handle part having a second width and a second thickness, said first width of said container portion being larger than said second width of said handle part such that edge portions of said container portion extend beyond said handle part, said second thickness of said handle part being larger than said first thickness of said container portion, said edge portions of said containers being folded such that the thickness of said folded edge portions is substantially equal to said second thickness of said handle part.

2. The delivery package of claim 1, further comprising at least one continuous cord or hoop for securing each of said containers to said rolling core.

3. The delivery package of claim 1, further comprising at least one continuous cord or hoop for securing said containers to said rolling core, said at least one continuous cord or hoop being in direct contact with only an outermost layer of said containers.

4. The delivery package of claim 3, wherein said at least one continuous cord or hoop comprises two cords or hoops spaced from one another.

5. The delivery package of claim 1, wherein each of said containers includes an outer bag and an inner bag arranged in said outer bag, said handle part securing both said inner bag and said outer bag.

6. The delivery package of claim 5, wherein said handle part is directly attached to said inner bag.

7. The delivery package of claim 1, wherein said rolling core has an axial length substantially equal to the width of said containers after said edge portions have been folded.

8. The delivery package of claim 1, wherein said handle part is situated at a longitudinal end of said container.

9. The delivery package of claim 1, wherein said edge portions of said containers are folded in a longitudinal direction of said containers.

10. A process for packing flexible intermediate bulk containers into a delivery package, comprising the steps of:

placing a plurality of flexible intermediate bulk containers on a packing line, each of the containers including a elongate container portion having a first width and a first thickness and a handle part connected to the container portion, the handle part having a second width and a second thickness, the first width of the container portion being larger than the second width of the handle part such that edge portions of the container portion extend beyond the handle part, the second thickness of the handle part being larger than the first thickness of the container portion, folding the edge portions of the containers such that the thickness of the folded edge portions is substantially equal to the second thickness of the handle part, and rolling the thus-folded containers in an overlapping relationship in layers about a rolling core into a delivery package.

11. The process of claim 10, wherein the edge portions are folded in a longitudinal direction of the containers.

12. The process of claim 10, wherein the step of folding the edge portions of the containers comprises the step of passing the containers through folding guides.

13. The process of claim 10, further comprising the step of securing each layer of the containers to the rolling core by means of at least one cord or hoop.

14. The process of claim 10, further comprising the step of securing only an outermost layer of the containers about the rolling core by means of at least one cord or hoop.

15. The process of claim 12, further comprising the step of feeding the containers to the folding guides in a folding station when a bottom of the container is in a feeding station.

* * * * *